US007647963B2

(12) United States Patent
Carstensen

(10) Patent No.: US 7,647,963 B2
(45) Date of Patent: Jan. 19, 2010

(54) INTERCONNECT ROD FOR SUCKER ROD STRING

(76) Inventor: Kenneth J. Carstensen, P.O. Box 8728, Houston, TX (US) 77249-8728

( * ) Notice: Subject to any disclaimer, the term of this patent is extended or adjusted under 35 U.S.C. 154(b) by 365 days.

(21) Appl. No.: 11/890,148

(22) Filed: Aug. 6, 2007

(65) Prior Publication Data

US 2008/0035329 A1 Feb. 14, 2008

Related U.S. Application Data

(60) Provisional application No. 60/837,563, filed on Aug. 14, 2006.

(51) Int. Cl.
*E21B 17/04* (2006.01)

(52) U.S. Cl. ..... 166/176; 166/241.4; 403/273

(58) Field of Classification Search ..... 166/176, 166/241.2, 241.4, 241.6; 403/273, 360, 404; 285/381.1, 417, 294.1
See application file for complete search history.

(56) References Cited

U.S. PATENT DOCUMENTS 838,448 A * 12/1906 Pitcher ..... 403/43
3,376,826 A * 4/1968 Crowe ..... 417/554
4,694,910 A * 9/1987 Towner et al. ..... 166/379
4,787,771 A * 11/1988 Allen ..... 403/370
4,919,560 A * 4/1990 Rutledge et al. ..... 403/268
5,577,737 A * 11/1996 Lacy ..... 277/308
5,769,161 A * 6/1998 Borden ..... 166/72
6,513,593 B2 * 2/2003 Prasad ..... 166/302
2006/0273601 A1 * 12/2006 Carstensen ..... 294/91

* cited by examiner

*Primary Examiner*—Jennifer H Gay
*Assistant Examiner*—Daniel P Stephenson
(74) *Attorney, Agent, or Firm*—Jones, Tullar & Cooper, P.C.; Raymond A. Bogucki

(57) ABSTRACT

A device for coupling a driver system to a downhole string of sucker rods in a petroleum well employs a polish rod construction in which the polish rod is strengthened by an attached sleeve providing a transverse should in a predetermined plane. The sleeve is shrink fit in place and mechanically adhered to withstand the stresses and shocks encountered in long-term cyclic operation. The device provides specific benefits for an improved sucker rod connection which prestresses the sucker rod pin ends and the coupling in a fashion to resist the development of microcracks and fatigue failures.

6 Claims, 5 Drawing Sheets

INTERCONNECT ROD FOR SUCKER ROD STRING

REFERENCE TO PRIOR APPLICATION

This invention relies for priority on previously filed provisional application No. 60/837,563, filed Aug. 14, 2006 by Kenneth J. Carstensen and entitled "Interconnect Rod for Sucker Rod String".

BACKGROUND OF THE INVENTION

A sucker rod string in a petroleum well extends from a power drive at the wellhead, down through the lengths of tubing and concentric casing used in a production system, and connects to the fluid pump at the lowest elevation in the system. The pump receives an accumulating petroleum inflow from the production zone somewhere above it and lifts a column of fluid up through the tubing. The power drive at the wellhead may be a reciprocating beam system, often called a horsehead, and the sucker rod string then reciprocates a downhole plunger pump which lifts fluid upward through the tubing. The power source may alternatively be a rotary drive coupled via the sucker rod string to a longitudinally extended progressing (or "progressive") cavity pump.

At the wellhead, the fluid product raised through the tubing is diverted to a lateral outflow and the flow path is closed off by seals about a special interconnection rod which couples the upper end of the sucker rod string to the horsehead or rotary drive. This interconnection rod, called a polish (or polished) rod, must meet stringent requirements because it must provide a low wear durable seal as well as withstand the tensions and stresses engendered by the well operation. It must bear the weight of the sucker rod string as the string cycles, as well as the mass of the fluid column that is being lifted, and it must also resist transitory forces which occur during the pumping, whether reciprocating or rotary. These forces arise variably from impacts, inertial variations and stresses induced longitudinally or by torsion. Since the polish rod reciprocates through fluid seals at the wellhead, it must function uniformly without leaking or undue friction through the operating life of the polish rod. For these reasons, the polish rod diameter is typically larger in diameter than the sucker rods in the string, and is of a suitable high strength material. To provide affective sealing, the surface of the polish rod is spray metal coated with a hard alloy and ground and polished to provide a long life uniform surface which introduces little wear.

Over years of development and use in the oil industry, technical changes have been made to meet constantly increasing artificial lift requirements. Thus a relatively early (pre-1940) specification from the American Petroleum Institute (API) defined a polish rod in which one end had a forged upset area, including a shouldered element having a rod pin machined on it. The other end had no shoulder but terminated in straight threads of a specified API polish rod design. The thread design terminated the straight threads with 3 partial threads along a 9° (nine degree) taper. The shouldered polish rod specification became effectively obsolete while lift requirements were still relatively low because it was felt that there was no structural need for the shoulder. Consequently, both ends of the polish rod have connection threads of the straight API polish rod type without a shoulder.

As artificial lift requirements increased because of increases in the depth of wells along with greater demand for petroleum products, new sucker rod designs were developed for greater performance. It became evident that the polish rod thread configuration often became a weak link in the rod string under more demanding conditions. Shock and impact forces encountered with gas or fluid pounding appeared to be the most frequent failure consideration, because these forces excessively stressed the polish rod connection threads as they alone absorbed longitudinal stresses and impact forces on the rod. Such breakdowns are aggravated because, it is well known, movement between threaded members tends to destroy the connection.

Polish rod connection failures were evidenced, for both beam pumping and progressive cavity pumping, by "belling out" (radial expansion) of the coupling due to the prior sucker rod design. In beam pumping systems the 9° terminal taper and partial threads allowed the tapered threat sections to go deeper and deeper into the coupling, causing threads to shear or even split the coupling. In rotary systems gas absorbed in the stator elastomer, results in torque increasing, which may be accompanied by torque spikes caused by the ingestion, by the pump of formation solids, with failures like those mentioned above.

Applicant has shown that prestressing of connections in sucker rod systems can be used to advantage, as described in Carstensen U.S. Pat. No. 6,942,254 issued Sep. 13, 2005, and Carstensen patent application Ser. No. 09/961,391 filed Jul. 25, 2001. Improvement of the polish rod connection so as to take advantage of these beneficial expedients while providing the needed structural and sealing properties are desirable objectives.

SUMMARY OF THE INVENTION

An improved polish rod system in accordance with the invention is configured for precise dimensional positioning and structural interaction with a sucker rod system. It provides the structural properties needed and an extremely durable construction for load cycling operation. The improved polish rod integrates a shoulder surface at a position that absorbs stresses both static and dynamic, transmitted along the sucker rod string and in the rod couplings. This improvement enables the connection to take advantage of prestressing, with or without an intermediate torque button.

A polish rod in accordance with the invention is externally configured to have the needed principal length and body diameter for the stress on the sucker rod string to which it is to be attached. The polish rod body is machined, ground and polished and spray coated with hardened material in accordance with prior practice, but includes a small diametral reduction for a predetermined length adjacent its lower end that has precisely defined end transitions. A shoulder fitting or sleeve of slightly smaller internal dimension than the reduced rod dimension but of the predetermined length is attached on the polish rod body, after being heated sufficiently to shrunk into place with secure engagement. A corner radius of curvature on the upper end of the shoulder sleeve engages a matched curvature at the corresponding end of the predetermined length of the polish rod, to aid in seating and retention. The sleeve includes a tapered section that diverges from its upper end to a mid-region transition and thereafter is of uniform cross section to its lower end. This end defines a transverse end shoulder in a transverse plane that is precisely aligned longitudinally with the end of a pin neck section in the polish rod. The pin neck provides stress relief and adjoins the terminating straight thread section which is compatible with the female thread in a sucker rod coupling. When the pin end is fully in threaded position in the coupling, the coupling end engages the transverse shoulder surface of the sleeve.

With this arrangement, a sucker rod coupling attached to the pin end and abutted against the shoulder surface can be precisely prestressed, in the fashion described in the aforementioned Carstensen patents, to resist the initiation and growth of microcracks and displacements between the threads during repetitive cycling under stress. Alternatively, the combination may include a torque button positioned between the end faces of a the polish rod and an opposing sucker rod end mounted in the coupling. Similar interconnections can be used at both ends of the polish rod, if a direct connection is not used, except that at the upper end the sleeve is inverted (relative to the orientation at the lower end) and the pin end is coupled directly or via an intermediate device to the primary cable.

BRIEF DESCRIPTION OF THE DRAWINGS

A better understanding of the invention may be had by reference to the following description, taken in conjunction with the accompanying drawings, in which:

FIGS. 2A and 2B, is a somewhat idealized, truncated view of a typical downhole petroleum well installation;

DETAILED DESCRIPTION OF THE INVENTION

Figure 1:
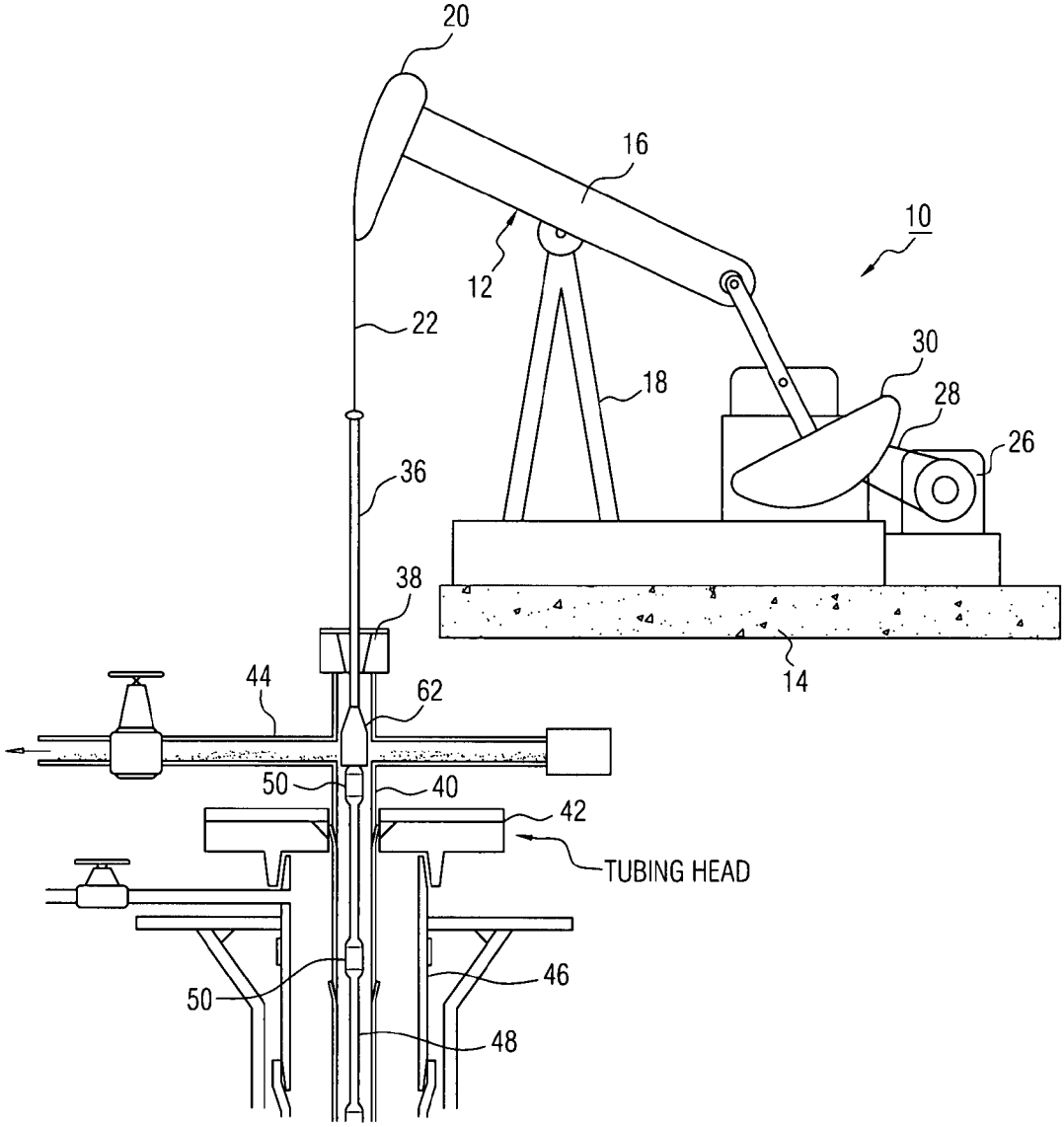
FIG. 1 is a somewhat idealized partial side and sectional view of a wellhead in which a polish rod in accordance with the invention is attached to a reciprocating pump drive.

FIG. 1, to which reference is now made, is an idealized general view of a wellhead installation 10 showing a horsehead type of drive 12 mounted on a base 14. In conventional fashion the beam 16 for the horsehead rocks on a pivot support 18 in a central region of the arm or beam 16. The head assembly 20 of the drive 12 controls the elevation of the sucker rod in the downhole installation via a primary cable 22 and an interconnecting polish rod. At the opposite end of the beam 16 is a drive motor 26 coupled by a belt 28 to a rotating counter-weight 30 that compensates in part for the mass of the sucker rod system and fluid being lifted.

Alternatively, as is well known, the sucker rod system can be driven circumferentially by a rotary drive (not shown) in which event the pumping structure at the downhole location is of the progressive cavity type. Load variations with the progressive cavity drive reflect not only the nominal metal and petroleum masses and inertial loads but also transient variations introduced by solids and gases in the product.

The primary cable 22 in this example couples directly to the upper end of a polish rod 36 having a conventional length which extends through a circumferential seal 38 into the vertical tubing 40 supported in part by an encompassing tubing head 42 which contains the polish rod seals. The polish rod 36 is not only about 1.5× the diameter of the sucker rods in the string but has a suitable length, such as 10 ft. to 36 ft. above the tubing head 42. Below the tubing head 42, the installation extends downhole in conventional fashion, within the tubing 40 sections that are concentric within a casing 46. The joined lengths of sucker rod sections 48 are centrally positioned within the tubing 40.

Figure 2:
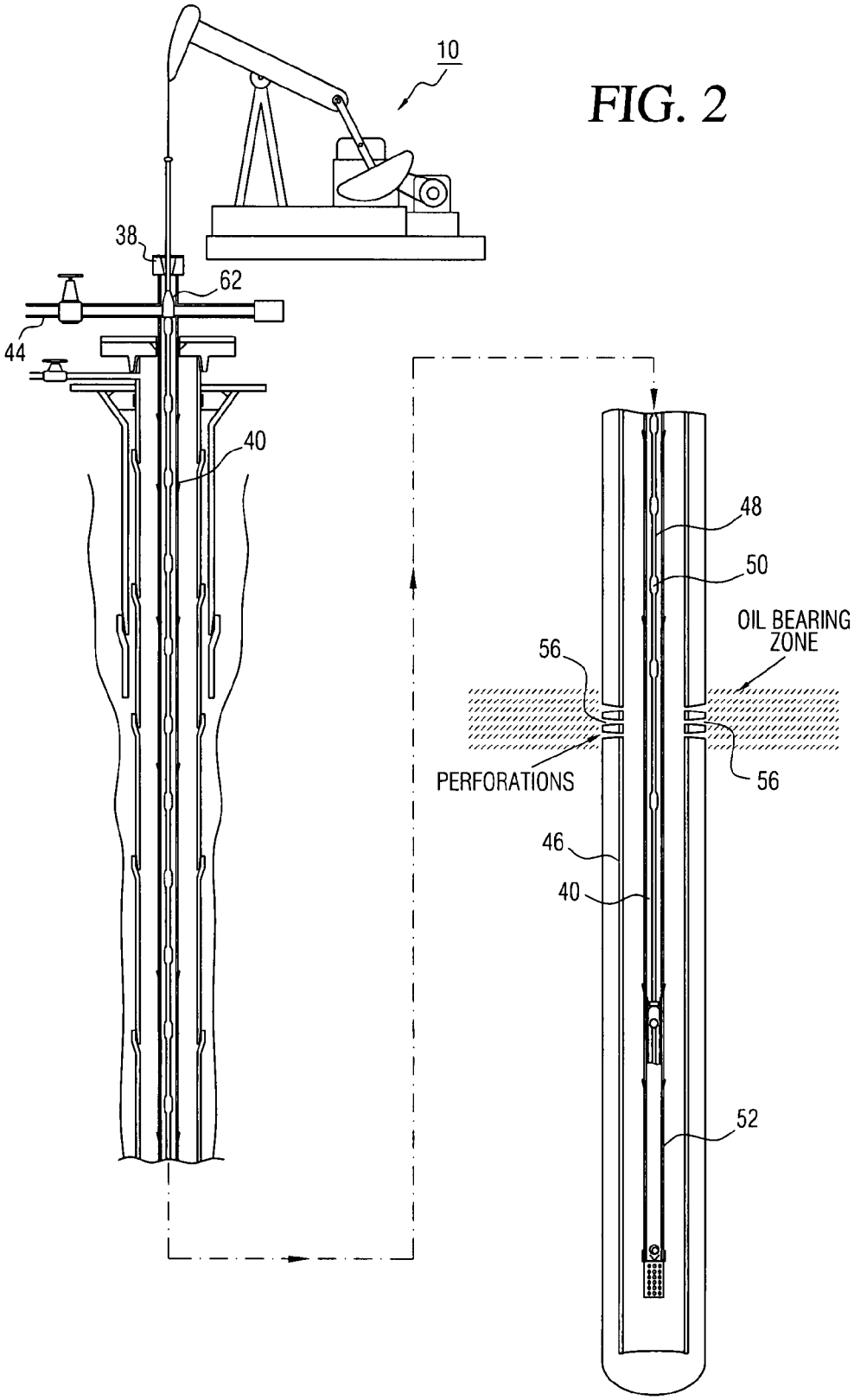
FIG. 2, comprising

The general downhole construction (as seen in FIG. 2) is well known, but is depicted because it is useful in explaining the forces and stresses introduced in the system. The sucker rod section lengths 48 are interconnected by couplers 50, and, as seen in the overall view of FIG. 2, the horsehead drive cycles the sucker rod system so that a plunger type of pump 52 (in the progressive cavity system this would be a rotary device) is reciprocated to lift fluid accumulated into the fluid column along the tubing. At the lowermost section of the tubular system a column of petroleum product builds along and within the interior of the tubing 40. Perforations 56 in the casing 46 are at an elevation accessible to the production zone, and above the pump level, so as to maintain the petroleum product flow into the interior annulus between the tubing 40 and casing 46. As the plunger 52 builds the fluid outflow column, the petroleum product level rises until the outflow line 44 is reached at or near the surface. The downhole installation will conventionally include cement (not shown) between the exterior of the casing 46 and the bore of the well. Further details are not shown in FIG. 2, because they are well understood and not relevant to the inventive structure.

Figure 3:
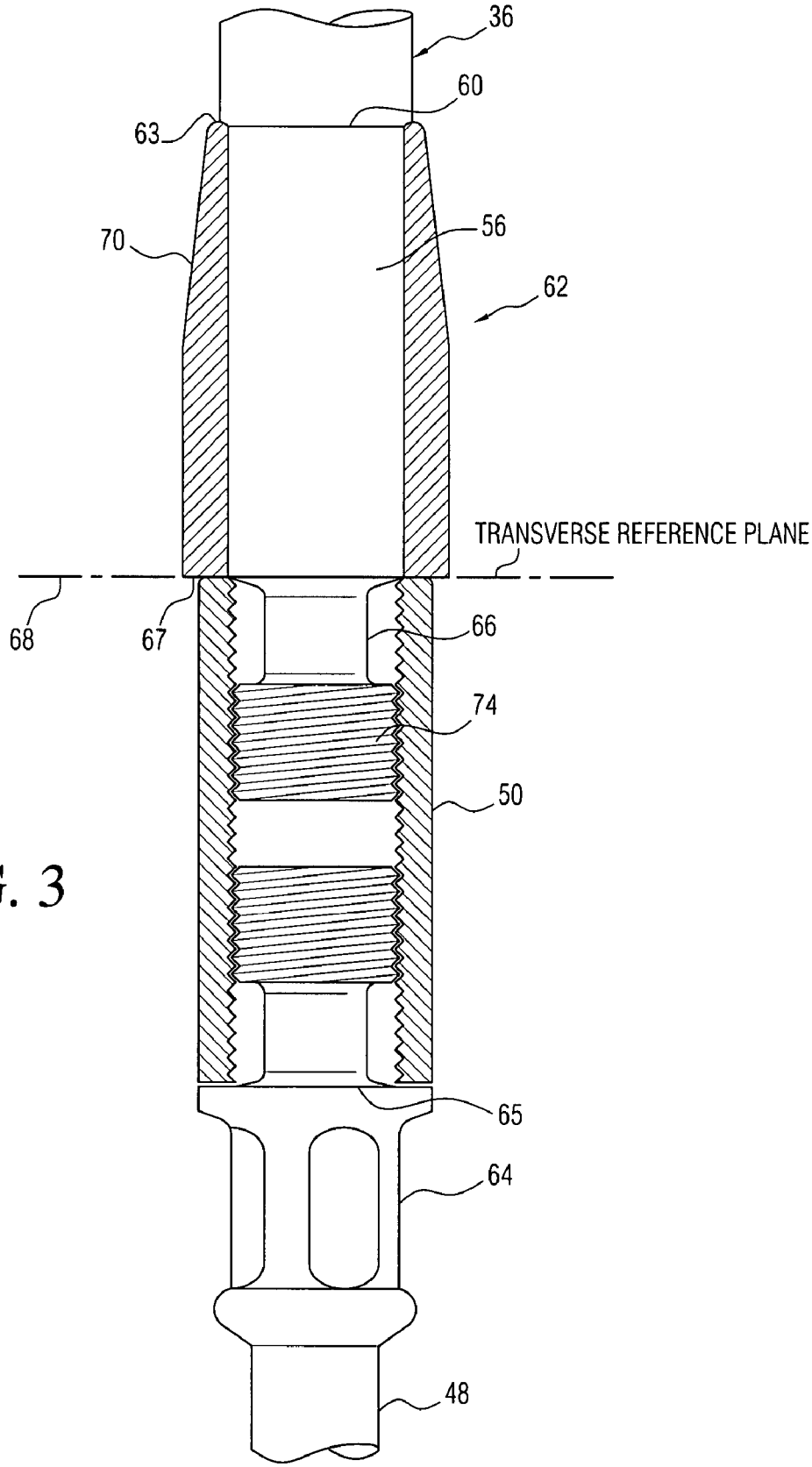
FIG. 3 is a side-sectional view of a polish rod combination in accordance with the invention, as related to a sucker rod coupling.
Figure 4:
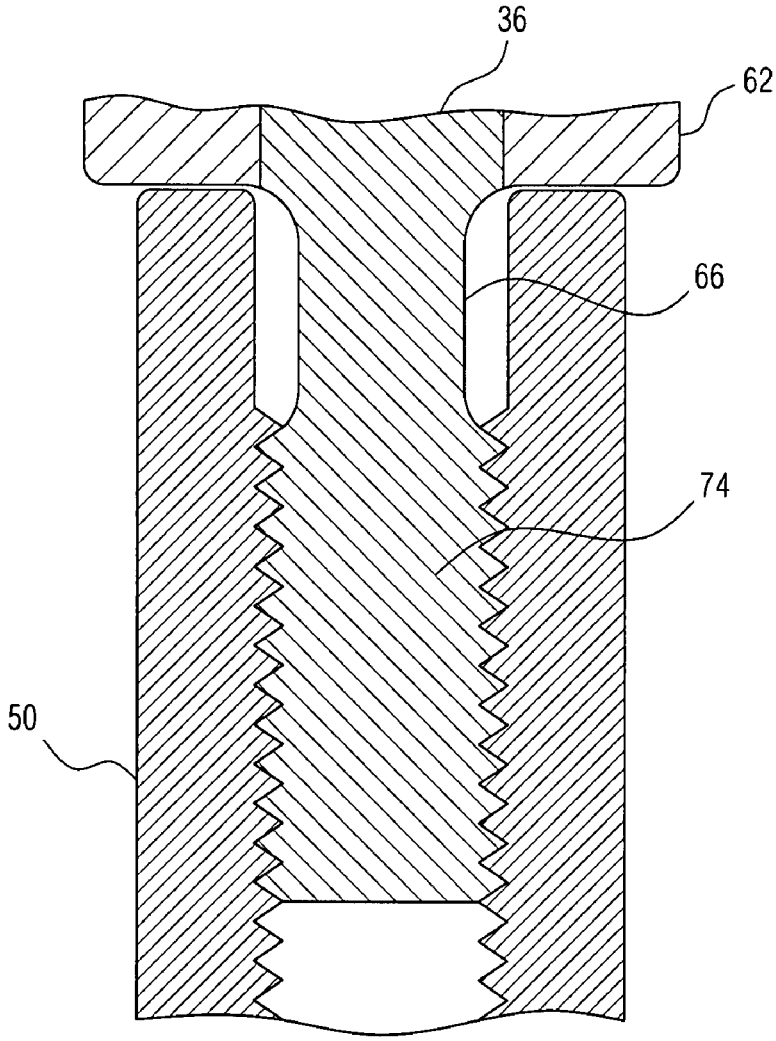
FIG. 4 is an enlarged side-sectional fragmentary view of the pin end of a polish rod combination in accordance with the invention.

In the polish rod 36 assembly, shown in greater detail in FIGS. 3 and 4, the polish rod 36 diameter is substantially constant throughout its entire uppermost segment. The terms "upper" and "lower" are used in a descriptive way only, to relate to the conventional usage of a polish rod assembly when connected to the upper section of a sucker rod string. For example, at its lower-end a 1.5" polish rod 36 diameter is reduced along a predetermined length of (approximately 5.832") long to a smaller diameter section 56, by machining off about 0.0615 inches from the surface. The upper edge of this length 56 is defined by a small transition ridge 60 having a precise radius of curvature (0.0625") between the adjoining longitudinal and transverse surfaces. A fitted sleeve 62 seats concentrically on the smaller diameter section 56 of the polish rod 36 and includes an upper corner 63 which matches the curved ridge 60 on the polish rod. The length of this sleeve 62 extends precisely to the start of the stress relief area 66 or neck on the polish rod 36 assembly, and terminates in a shoulder 67 lying in the transverse plane 68. The shoulder 67 surface on the sleeve 62 the precise geometric reference surface used for the prestressed coupling in accordance with the referenced Carstensen teachings.

Along its upper section the fitted sleeve 62 includes a downwardly diverging tapered section 70 which merges smoothly in a mid-region of the sleeve 62 into a constant outer diameter section terminating at the transverse and shoulder 67 surface. On the end portion of the polish rod 36, the neck or relief area 66 merges to a straight threaded section 74 mating with the internal female threads on the sucker rod coupling 50.

When assembled, as also seen in FIG. 4, the coupling 50 receives the pin end of a sucker rod 48, and when the polish rod 36 and the sucker rod pin end are tightened to a selected prestress level, as per the Carstensen patents referenced above, the connection inhibits the loosening of the threaded connection under cyclic high load operation. This also inhibits the initiation and development of micro-cracks.

Figure 5:
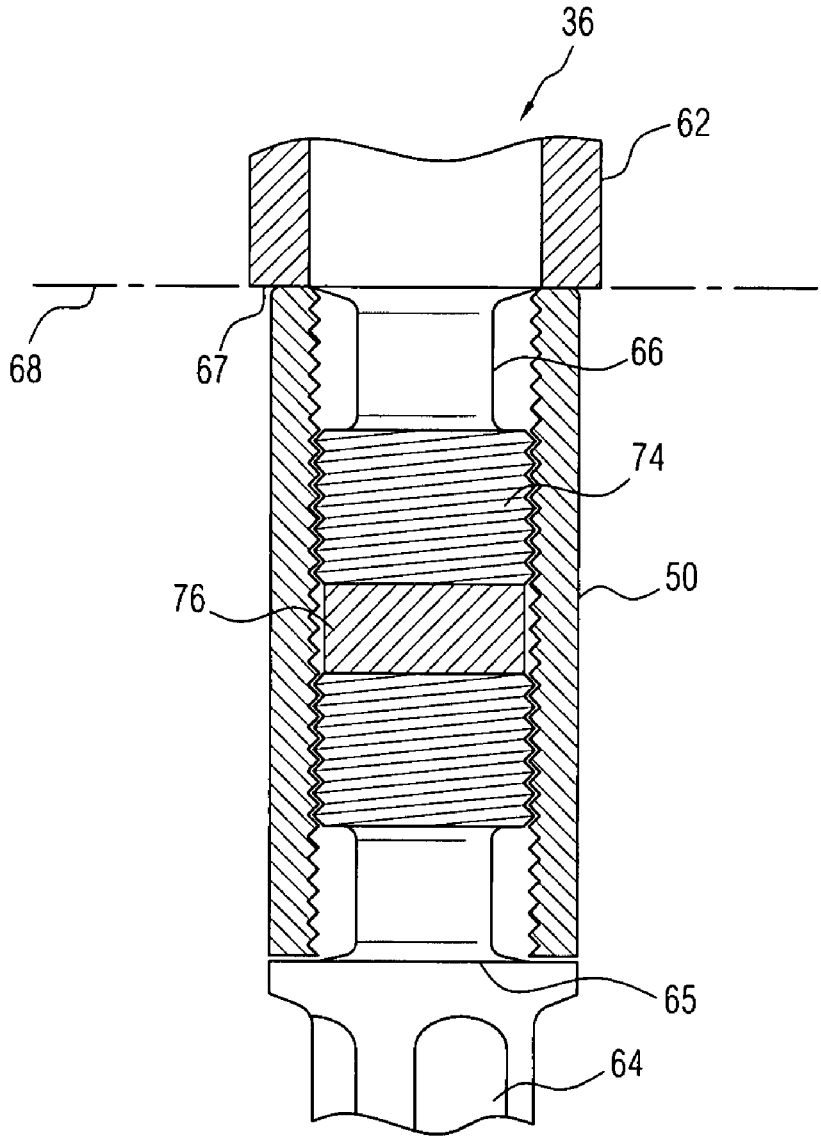
FIG. 5 is a side-section fragmentary view of a polish rod combination including a torque button insert.

As seen in FIG. 5, a torque disk 86 can be incorporated between the end faces of the pin ends of the sucker rod 48 and the polish rod 36 assembly. The coupling 50 itself again abuts the shoulder 62 at one end and the shoulder on the sucker rod 48 at the other. Prestress can again be applied to assure that incremental movement and displacement between the mating threads does not occur. The sucker rod 48 includes a wrench flat 64 adjacent the transverse end shoulder 6 which engages the coupling 50.

The polish rod assembly, as previously expressed, has a diameter that is greater than the diameter of the sucker rod with which it is being used. Other sizes of sucker rods and polish rods may be used, in accordance with the following chart given as an example only.

| Nominal Size of Sucker Rod | ⅝ | ¾ | ⅞ | 1 | 1¾ |
|---|---|---|---|---|---|
| Length Polish Rod Pin | 1.125 | 1.375 | 1.375 | 1.750 | 2.000 |
| Diameter of Polish Rod Pin Shank | 0.9362 | 1.0611 | 1.1861 | 1.3235 | 1.3609 |

The incorporation of a physically united sleeve 62 on the reduced diameter length of the polish rod involves using a sleeve 62 which is 0.003" to 0.004" less in diameter than the outer diameter of the reduced diameter length. The sleeve 62 is heated to between 600° and 750° F. to expand it sufficiently to slip over the dedicated length of the polish rod. When in proper position, which is precisely defined by the curved ridge 60, the sleeve 62 is in effect physically united with the polish rod 36 on cooling, and withstands the loads that encountered on cyclic operation.

With polish rods provided in accordance with the invention, cyclically varying loads, such as are encountered with a modern pumping system, are buffered by coupling to shoulder contact as well as contact at the threaded flanks. Furthermore existing parts inventories of polish rods can be employed after modification at service centers or even on site.

Although modifications and variations of devices in accordance with the invention have been described, the invention is not intended to be limited to such but is to apply to all expedients within the scope of the appended claims.

The invention claimed is:

1. A polish rod device providing an elongated member for interconnecting a petroleum well sucker rod string to a wellhead primary cable at one end while supporting the mass of the string, and petroleum product, and withstanding frictional and inertial forces, and comprising:

a cylindrical polish rod having a nominal diameter of greater cross-sectional area than the sucker rods in the string and adapted to couple at its upper end to the primary cable, the lower end of the polish rod terminating in a length of untapered thread and including an adjacent pin neck terminating at its upper end at a transverse plane, a seating length of polish rod adjacent the transverse plane on the upper side thereof and having a diameter that is smaller by a predetermined amount that the nominal diameter of the polish rod, and said seating length terminating in a shoulder abutting the principal body of the polish rod; and an outer sleeve mounted with a shrink fit on the seating length of the polish rod from the transverse plane to the curved shoulder, the sleeve providing a shoulder at the transverse plane.

2. A rod device as set forth in claim 1 above, wherein the outer sleeve includes a diminishing taper from a mid-region to the transverse plane, and wherein the polish rod includes a hardened, low friction surface and wherein the outer sleeve has an inner diameter that is less than about 0.004" smaller than the outer diameter of the seating length.

3. A rod device as set forth in claim 2 above, wherein the sleeve has an inner diameter which is about 0.003" to about 0.004" less than the seating diameter on the polish rod, and the terminating shoulder of the reduced diameter section of the polish rod is curved, and the sleeve includes an adjacent end that is curved to match the curve of the terminating shoulder.

4. A coupling for engaging a polish rod as set forth in claim 1 above to a sucker rod string comprising a coupling having internal threads engaging the threaded terminal end of the polish rod, and a sucker rod having a terminal threaded section joined in the opposite end of the sleeve.

5. A coupling as set forth in claim 4 above, wherein the coupling further includes a torque button positioned between and engaging the ends of the terminal threaded sections, and wherein the polish rod and sucker rods are prestressed within the coupling against the torque button.

6. A rod device for interconnecting the prime cable coupled to a reciprocating pump drive to a sucker rod string used in a petroleum well, comprising:

a polish rod having a length of from about 10' to about 36' and a principal diameter greater than that of the sucker rods in the string, the rod including a hardened coating; the rod further including a terminal section for engagement with a sucker rod coupling, including a terminal male threaded section, an adjacent relatively narrower pin neck section, and a transverse shoulder adjacent the pin neck and lying in a transverse plane relative to the polish rod central axis, a first predetermined length of the polish rod on the opposite side from the pin neck and of a predetermined lesser diameter than the principal diameter of the polish rod;

an exterior sleeve of the predetermined length that is shrink fit on to the lesser diameter section of the polish rod and terminating in a shoulder lying in the transverse plane, the sleeve having a substantially constant outer dimension from the predetermined plane to a mid region at which the outer dimension tapers to a minimum at the predetermined length.

* * * * *